United States Patent [19]

Shibaoka et al.

[11] 4,322,493

[45] Mar. 30, 1982

[54] REVERSAL PROCESSING METHODS FOR BLACK AND WHITE PHOTOGRAPHIC LIGHT-SENSITIVE MATERIALS

[75] Inventors: Haruo Shibaoka; Katsumi Hayashi, both of Minami-ashigara, Japan

[73] Assignee: Fuji Photo Film Co., Ltd., Minami-ashigara, Japan

[21] Appl. No.: 78,872

[22] Filed: Sep. 26, 1979

[30] Foreign Application Priority Data

| | | | |
|---|---|---|---|
| Sep. 26, 1978 | [JP] | Japan | 53-118185 |
| Sep. 27, 1978 | [JP] | Japan | 53-118987 |
| Dec. 22, 1978 | [JP] | Japan | 53-162265 |

[51] Int. Cl.[3] ..... G03C 5/50

[52] U.S. Cl. ..... 430/407; 430/454; 430/461; 430/462; 430/487; 430/489; 430/379

[58] Field of Search ..... 430/407, 454, 461, 462, 430/487, 489, 379

[56] References Cited

U.S. PATENT DOCUMENTS

| | | | |
|---|---|---|---|
| 3,576,633 | 4/1971 | Henn et al. | 430/407 |
| 3,617,283 | 11/1971 | Ohi et al. | 430/393 |
| 3,640,717 | 2/1972 | Gallet et al. | 430/407 |
| 4,108,661 | 8/1978 | Vanassche et al. | 430/407 |

OTHER PUBLICATIONS

Hornsby: Photographic Chemistry, vol. one, Fountain Press, London, May 20, 1960.

*Primary Examiner*—Won H. Louie, Jr.
*Attorney, Agent, or Firm*—Sughrue, Mion, Zinn, Macpeak and Seas

[57] ABSTRACT

A reversal development processing method for black and white silver halide photographic light-sensitive materials which comprises bleaching an imagewise exposed black and white silver halide photographic light-sensitive material with a bleaching solution containing at least one oxidizing agent capable of forming a water-soluble silver salt when reacted with the silver images of said exposed light-sensitive material in the presence of at least one bleach accelerating agent selected from the compounds represented by the general formulae (I) to (VIII) described in the specification.

15 Claims, No Drawings

REVERSAL PROCESSING METHODS FOR BLACK AND WHITE PHOTOGRAPHIC LIGHT-SENSITIVE MATERIALS

BACKGROUND OF THE INVENTION

1. Field of the Invention

The present invention relates to a reversal development processing method for black and white silver halide photographic light-sensitive materials and, more particularly, to a means for accelerating bleaching in reversal development processing of light-sensitive materials.

2. Description of the Prior Art

As is disclosed in "Kagakushashinbinran chū", pp. 69 to 71 (published by Maruzen, Japan), it is well known that positive images can be obtained by reversal photographic processing which comprises developing an imagewise exposed light-sensitive material to form silver images, removing the silver images by bleaching, exposing the undeveloped silver halide and developing the silver halide. Since a reversal processing method provides positive images directly by development, it is useful in the reproduction fields such as for reproducing movies, documents, drawings, etc.

It is essential in reversal processing of light-sensitive materials that silver images are completely removed by bleaching after the silver images are formed by developing the latent images formed in the light-sensitive materials by imagewise exposure. In photographic processing fields, a so-called color light-sensitive material is also processed by a method including a bleaching step. However, silver images are not necessarily removed in the bleaching step of color light-sensitive materials. For example, silver images can be rehalogenated to silver halide which is then fixed and removed. On the contrary, if silver images of a black and white light-sensitive material are not completely removed in the bleaching step, the exposed areas are no different than the unexposed areas after forming the reversal images by second development of the silver halide undeveloped by the first development, and, as a result, unacceptable reversal images having much fog and less contrast are formed.

As a bleaching solution for black and white light-sensitive materials, a composition is available containing an oxidizing agent for silver images such as permanganate, persulfate, bichromate, ferricyanide, cerium salt, ferric salt, cupric salt, a metal complex salt of an aminopolycarboxylic acid, etc., or mixtures thereof. Of these compounds, a heavy metal compound such as permanganate or bichromate, and a compound having a cyanide ion such as ferricyanide are not preferably employed because they can be harmful to animals and plants when they occur in waste water, etc. A metal complex salt of an aminopolycarboxylic acid, on the other hand, is not a preferred bleaching agent for black and white reversal processing because the speed with which it bleaches developed silver is slower than other bleaching agents and because the monovalent silver formed by bleaching is not converted into a water-soluble compound, and oxidized silver is not removed from the light-sensitive materials.

A ferric salt, a cerium salt and a persulfate are preferred bleaching agents for black and white light-sensitive materials because they do not present pollution problems and because they convert monovalent silver to a water-soluble silver compound. However, their bleaching speed for black and white light-sensitive materials is not satisfactorily fast. Particularly, where they are employed for rapid processings, the bleaching speed of the compounds is insufficient because the bleaching time plays a large part in the total processing time. For example, the developing step, stopping step and fixing step of reversal processing in making microfilm are completed in several seconds to several tens of seconds, but the bleaching step using a bleaching agent other than a bichromate and a ferricyanide takes at least 30 seconds and in many cases more than several minutes. In other words, an oxidizing agent capable of converting developed silver into a water-soluble silver compound without pollution problems such as a ferric salt, a cerium salt or persulfate may not be suitable for a rapid reversal processing of black and white light-sensitive materials due to its low bleaching speed.

SUMMARY OF THE INVENTION

A first object of the present invention is to provide a reversal processing method for black and white light-sensitive materials using a bleaching solution which is less harmful to animals and plants.

A second object of the present invention is to provide a rapid reversal processing method for black and white light-sensitive materials.

A third object of the present invention is to provide a reversal processing method for black and white light-sensitive materials capable of forming images having less fog and good contrast.

These objects of the present invention and others can be attained by bleaching imagewise exposed black and white silver halide photographic light-sensitive materials with a bleaching solution containing an oxidizing agent capable of converting silver images into a water-soluble silver salt in the presence of a bleach-accelerating agent represented by one of the formulae (I) to (III) and (V) to (VIII):

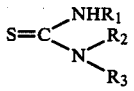
(I)

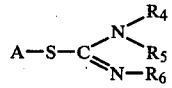
(II)

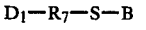
(III)

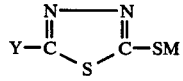
(V)

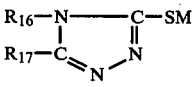
(VI)

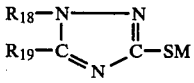
(VII)

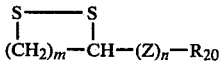
(VIII)

DETAILED DESCRIPTION OF THE INVENTION

In the formulae (I) and (II), $R_1$ to $R_6$ each is a hydrogen atom, a straight or branched chain alkyl group having 1 to 6 carbon atoms, a hydroxyalkyl group having 1 to 6 carbon atoms, a monocyclic aryl group, or a monocyclic aralkyl group having 7 to 10 carbon atoms which may be substituted with a halogen atom or a sulfo group, provided that $R_1$, $R_2$ and $R_3$ do not simultaneously represent halogen, and $R_1$ and $R_2$, $R_2$ and $R_3$, $R_4$ and $R_5$ or $R_5$ and $R_6$ may combine to form a saturated or unsaturated 5-membered ring such as imidazole ring or imidazoline ring provided $R_1$, $R_2$ and $R_3$ are not hydrogen atoms at the same time, and A is a hydrogen atom or a hydrocarbon group having 1 to 10 carbon atoms such as an alkylene group which may be substituted with a carboxy group, a sulfo group, a hydroxy group or an amino group, which may contain an alkylamino group having 1 to 3 carbon atoms.

In the formula (III), $D_1$ is a hydrogen atom, a hydroxy group or

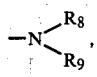

$R_8$ and $R_9$ each is a hydrogen atom, a methyl group or an ethyl group, $R_7$ is an alkylene group having 1 to 4 carbon atoms which may be substituted with a hydroxy group, a mercapto group or a carboxy group, B is a hydrogen atom or $—S—R_{10}—D_2$, where $D_2$ is a hydrogen atom, a hydroxy group or

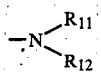

wherein $D_1$ and $D_2$ are not hydrogen atoms at the same time, $R_{11}$ and $R_{12}$ have the same definition as $R_8$ and $R_9$, respectively, $R_{10}$ has the same definition as $R_7$, and preferably $D_1$ and B are not hydrogen atoms at the same time.

In the formula (V), Y is —SM, an amino group which may contain an alkylamino group having 1 to 3 carbon atoms, $—SR_{15}$ or $—R_{15}$, and $R_{15}$ is a straight or branched chain alkyl group having 1 to 4 carbon atoms, a straight or branched chain alkoxy group having 1 to 4 carbon atoms, an allyl group or an unsubstituted or substituted phenyl group.

In the formulae (VI) and (VII), $R_{16}$, $R_{17}$, $R_{18}$ and $R_{19}$ each is a hydrogen atom, a straight or branched chain alkyl group having 1 to 4 carbon atoms, a straight or branched chain alkoxy group having 1 to 4 carbon atoms or an unsubstituted or substituted phenyl group.

In the formula (VIII), Z is an alkylene group having 1 to 6 carbon atoms such as methylene, ethylene, propylene, butylene, hexylene, etc., $R_{20}$ is a carboxy group, a carboxylic acid salt group, a carboxylic acid ester group or a carboxylic acid amido group, m is 2 or 3, and n is 0 or 1.

In the formulae (V) to (VII), the substituents of phenyl group for $R_{15}$ to $R_{19}$ include a halogen atom, a nitro group, a carboxyl group, a hydroxyl group, a straight or branched chain alkyl group having 1 to 5 carbon atoms, a straight or branched chain alkoxy group having 1 to 5 carbon atoms or a sulfo group which may be an alkali metal salt such as a sodium salt or a potassium salt or an ammonium salt, and M is a hydrogen atom, an alkali metal, an ammonium ion, a straight or branched chain alkyl group having 1 to 4 carbon atoms or an alkoxy group having 1 to 4 carbon atoms.

The bleach-accelerating agents used in the present invention are all known in the photographic field. For example, a compound similar to the bleach-accelerating agent of the present invention is added to a reducer which is used to remove portions of silver images in black and white light-sensitive materials, as disclosed in Japanese Patent Application (OPI) No. 68419/77 (The term "OPI" as used herein refers to a "published unexamined Japanese patent application"). In this case, however, only the ability of the compound to dissolve silver only was considered since the silver halide was removed in a fixing step before reducing. On the contrary, where black and white light-sensitive materials are subjected to reversal development as in the present invention, the silver halide remains and is developed. Thus, a compound employed as a bleach-accelerating agent would not be suitable solely because it has a bleach-accelerating action. It must also not reduce sensitivity or form coarse grains of developed silver upon development after bleaching. To this point, the bleach-accelerating agent used in the present invention has properties different than those compounds used as a reducer.

As pointed out above, the bleach-accelerating agents used in the present invention are known compounds. They can be easily synthesized by the skilled artisan. For example, an alkylmercapto compound can be synthesized in accordance with the process described in *Organic Functional Group Preparations,* Vol. 1, pp. 479 to 485 edited by S. R. Sandler & W. Karo, 1968, Academic Press, and a heterocyclic mercapto compound can be synthesized in accordance with the process described in *The Chemistry of Heterocyclic Compounds* edited by A. Weirsberger & E. C. Taylor, John Wiley & Sons.

A bleach-accelerating agent for multilayer color light-sensitive materials the same as or similar to some of the promoters of the present invention has been used as disclosed in U.S. Pat. No. 3,617,283, Japanese Patent Application (OPI) Nos. 147944/75 and 58532/77, British Pat. No. 1,138,843 and Swiss Pat. No. 336,257, and a compound the same as or similar to some of the compounds of the present invention has been used in fixing after bleaching as disclosed in Japanese Patent Application (OPI) No. 137335/77 and *Research Disclosure* 15,704. However, these compounds are used for accelerating rehalogenation in which the silver images are rehalogenated and removed and, thus, their function is different than in the present invention in which the silver images are directly converted into water-soluble silver salts. That is, when black and white light-sensitive materials are subjected to a reversal processing as in the present invention, the compound used as a bleach-accelerating agent must not adversely influence subsequent processing steps (e.g., second exposure or second development) after bleaching. On the contrary, color light-sensitive materials are subjected only to simple processing steps such as washing or drying after bleaching such as a bleach-fixing for rehalogenation or bleaching and fixing, and, therefore, their affects on subsequent development are not as important. In other words, where a compound is used as a bleach-accelerating agent for color light-sensitive materials, only its bleach-accelerating effect is taken into consideration. The properties required of a bleach-accelerating agent are different in bleaching black and white light-sensitive materials where the affect of the agent on subsequent processing is a very important consideration.

Iodides and thioureas are also known as bleach-accelerating agents. However, if these compounds are used in reversal processing black and white light-sensitive materials, photographic properties are markedly decreased. For example, there is an increase in the density of non-image areas, a decrease in the density of image areas or a change in image tone.

The bleach-accelerating agent of the present invention is not only effective in the accelerating bleaching for reversal development processing of black and white light-sensitive materials, but it does not chemically influence the silver halide present in the light-sensitive materials with silver image during bleaching, and it does not adversely affect subsequent processing such as second exposure or second development in reversal processing after bleaching.

Representative examples of compounds represented by the formula (I) are shown below:

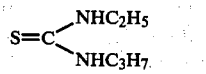
(1)

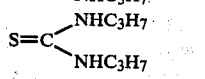
(2)

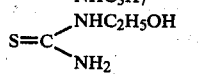
(3)

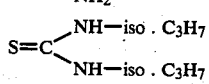
(4)

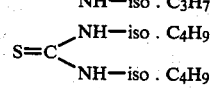
(5)

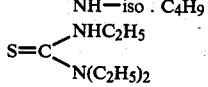
(6)

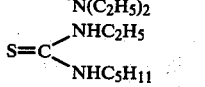
(7)

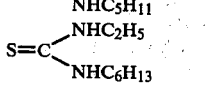
(8)

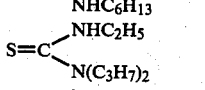
(9)

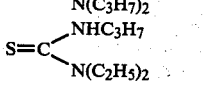
(10)

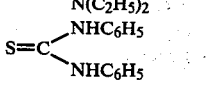
(11)

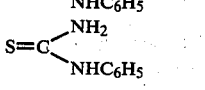
(12)

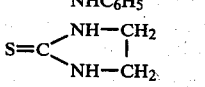
(13)

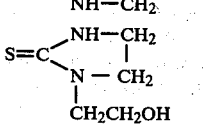
(14)

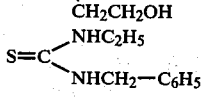
(15)

Representative examples of compounds represented by the formula (II) are shown below:

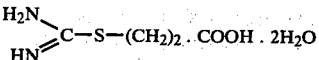
(16)

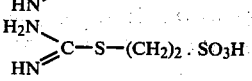
(17)

-continued

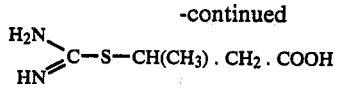
(18)

Representative examples of compounds represented by the formula (III) are listed below:

(19) Monothioglycerol
(20) Cysteine
(21) Cystamine
(22) Cystine
(23) Dimethylaminoethanthiol
(24) Dimethylaminopropanthiol
(25) 2-Aminoethanthiol
(26) 3-Aminopropanthiol
(27) Diethylaminoethanthiol
(28) N-Methyl-N-ethylaminoethanthiol
(29) Dimethylaminobutanthiol
(30) Diethylaminobutanthiol Representative examples of compounds represented by the formula (V) are shown below:

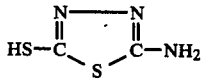
(33)

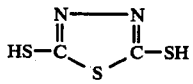
(34)

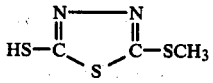
(35)

Representative examples of compounds represented by the formula (VI) are shown below:

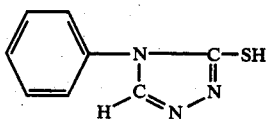
(36)

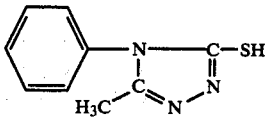
(37)

Representative examples of compounds represented by the formula (VII) are shown below:

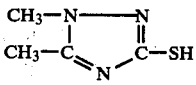
(38)

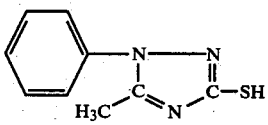
(39)

Representative examples of compounds represented by the formula (VIII) are shown below:

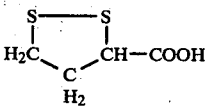
(40)

-continued (41)

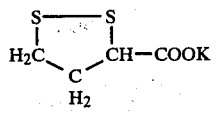

(42)

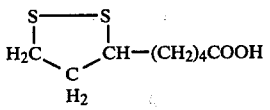

(43)

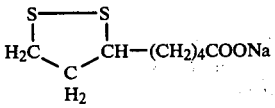

(44)

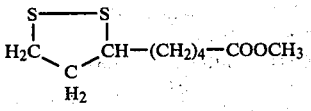

(45)

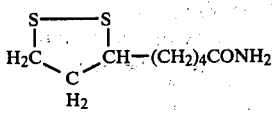

(46)

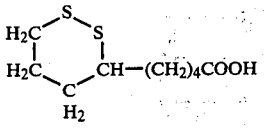

Compounds Nos. 13, 16, 23, 33, 34, 36, 37, 38, and 42 are preferred and Compounds 13, 37 and 42 are particularly preferred.

The reversal processing of black and white light-sensitive materials practiced in the present invention is basically made up of the following steps:

| | |
|---|---|
| (1) First development | [(2) Stopping development] |
| (3) Bleaching | (4) Rinsing |
| (5) Second exposure* | (6) Second development |
| [(7) Fixing] | (8) Washing or rinsing |
| [(9) Washing] | (10) Drying |

*As explained below second exposure is not limited to irradiation but includes some chemical treatments.

Optionally, at least one of steps (2), (7) and (9) can be omitted and for this reason they are shown in brackets. A washing step can be provided between steps.

The bleach-accelerating agent of the present invention can be incorporated into a bleaching solution or a bath before the bleaching step.

The bleach-accelerating agent is generally added to a processing solution. It can be added to a bleaching solution in the above step (3), a first developing solution in step (1), or in two or more of steps (1), (2) and (3). It is most preferred to add the agent to a stop bath in step (2) because the bleach-accelerating agent is more stable in the stop bath.

In general the bleach-accelerating agents are used in an amount of from about 0.0001 mol/liter to the solubility of the compound. More specifically the compounds represented by the formulae (I) or (II) are preferably added in an amount of about 0.0001 to 0.5 mol/liter, more preferably about 0.0005 to 0.05 mol/liter. The compound represented by the formula (III) is preferably added in an amount of about 0.001 to 1.0 mol/liter, more preferably about 0.005 to 0.1 mol/liter, and the compounds represented by the formulae (V), (VI), (VII) or (VIII) are preferably added in an amount of about 0.0005 to 0.005 mol/liter.

Light-sensitive materials which are subjected to reversal processing in the present invention are imagewise exposed in a usual manner and developed to obtain negative images. The development is usually a so-called first development. The development of silver halide remaining after removing the developed silver formed in the first development by bleaching is called a second development.

The developing solution employed in the first and second developments is an aqueous alkaline solution containing a conventional developing agent. The developing agents suitable for use in the present invention include dihydroxybenzenes (e.g., hydroquinone, chlorohydroquinone, bromohydroquinone, isopropylhydroquinone, toluhydroquinone, methylhydroquinone, 2,3-dichlorohydroquinone, 2,5-dimethylhydroquinone, etc.), 3-pyrazolidones (e.g., 1-phenyl-3-pyrazolidone, 1-phenyl-4-methyl-3-pyrazolidone, 1-phenyl-4,4-dimethylpyrazolidone, 1-phenyl-4-ethyl-3-pyrazolidone, 1-phenyl-5-methyl-3-pyrazolidone, etc.), aminophenols (e.g., o-aminophenol, p-aminophenol, N-methyl-o-aminophenol, N-methyl-p-aminophenol, 2,4-diaminophenol, etc.), pyrogallol, ascorbic acid, 1-aryl-3-aminopyrazoline-3-aminopyrazolones (e.g., 1-(p-hydroxyphenyl)-3-aminopyrazoline, 1-(p-methylaminophenyl)-3-aminopyrazoline, 1-(p-amino-m-methylphenyl)-3-aminopyrazoline, etc.), p-phenylenediamines (e.g., 4-amino-N,N-diethylaniline, 3-methyl-4-amino-N,N-diethylaniline, 4-amino-N-ethyl-N-$\beta$-hydroxyethylaniline, 3-methyl-4-amino-N-ethyl-N-$\beta$-methanesulfonamidoethylaniline, 4-amino-3-methyl-N-ethyl-N-$\beta$-methoxyethylaniline, etc.) and mixtures thereof.

The developing solution may contain preservatives (e.g., sulfite or bisulfite), buffering agents (e.g., carbonate, boric acid, borate, phosphate or alkanolamine), alkali agents (e.g., hydroxide, carbonate or phosphate), solubilizing agents (e.g., polyethylene glycols or esters thereof), pH controlling agents (e.g., organic acids such as acetic acid), sensitizing agents (e.g., quaternary ammonium salt), surface active agents, antifoggants (e.g., halide such as potassium bromide or sodium bromide, benzotriazole, benzothiazole, tetrazole, thiazole), and chelating agents (e.g., aminopolycarboxylic acid and salts thereof such as ethylenediamine tetraacetic acid, or polyphosphate).

A development accelerator is usually added in an amount of about $1\times10^{-2}$ to $5\times10^{-1}$ mol/l to a first developing solution to complete the development of coated silver halide where the light-sensitive materials are sufficiently subjected to imagewise exposure. As the development accelerators, a thiocyanate has been widely used and other conventional compounds such as thiosulfate, thiourea derivative, amines or alkyl-substituted imidazole are used.

A stop bath is used for quickly stopping the development reaction to obtain desired results of development, and protects the bleaching solution by preventing a reduction of its bleaching power by transportation of developing solution into the bleaching solution. For this purpose, water, an aqueous solution of a mineral acid such as sulfuric acid or hydrochloric acid, and an aqueous solution of an organic acid such as acetic acid or citric acid may be used. In the stop bath, the acid is used for neutralizing the alkali in the developing solution, and just about any compound can be used if it fulfills this purpose.

The bleaching agents used in the present invention are oxidizing agents capable of forming a soluble silver oxide, preferably a ferric salt and a cerium salt, particularly preferably a cerium salt. Inorganic ferric salts and cerium salts are less harmful to animals and plants, are preferably used, and they may be used alone or in combination. Where the bleaching agent is a metal salt, it is preferably a sulfate or nitrate which are capable of converting an oxidized silver ion into a water-soluble silver salt. The amount of the bleaching agent in the bleaching solution is usually about 1/30 to 1 mol/liter, preferably about 1/15 to ½ mol/liter. Where the bleaching agent is a persulfate, the amount of persulfate is about 1/20 to ⅔ mol/liter, preferably about 1/10 to ½ mol/liter. The pH of the bleaching solution in the present invention is not more than 3, preferably 0 to 1 to maintain oxidizing power and stability. In the bleaching solution, an inorganic acid such as sulfuric acid, hydrochloric acid or nitric acid may be added, if necessary. The bleaching solution is preferably used at the temperature of about 10° to 45° C.

The rinsing solution may have a conventional composition. That is, an alkali metal sulfite or an alkali metal bisulfite may be used alone or in combination. Further, an organic acid such as acetic acid, citric acid or tartaric acid, or a salt thereof, a silver halide solvent such as thiosulfate, an aminopolycarboxylic acid or a salt thereof, or a metal chelating agent such as polyphosphate may be added to the rinsing solution.

A fixing solution is used to dissolve and remove an undeveloped silver halide, and contains a silver halide solvent as a main component such as thiosulfate (e.g., ammonium thiosulfate or sodium thiosulfate), thiourea or amine derivatives, and further contains a sulfite such as ammonium sulfite, sodium bisulfite, sodium sulfite or potassium metabisulfite, a borate such as boric acid, borax or sodium metaborate, an organic carboxylic acid such as acetic acid, citric acid, tartaric acid or malic acid, an inorganic acid such as sulfuric acid or hydrochloric acid, an amine such as ethylenediamine, diethanolamine or triethanolamine, a water-soluble aluminum salt such as potassium alum, ammonium alum, aluminum sulfate or aluminum chloride, an organic compound such as methanol, ethylene glycol, diethylene glycol, triethylene glycol, polyethylene glycol, polyoxyethylene glycol or acetone, and if necessary an iodide compound such as potassium iodide or sodium iodide.

It will be clear to those skilled in the art that the second exposure in the above step (5) is not necessarily carried out by light. For example, a fogging treatment can be conducted with a fogging bath containing a strong fogging agent such as potassium borohydride, sodium sulfate or stannous chloride instead of fogging step using light. Further, the second exposure can be omitted by using a fogging developing solution containing a fogging agent such as hydrazine as the second developing solution.

A silver halide reversal method which is well known and in which the silver halide in the bleached and rinsed light-sensitive materials is used to form images can be applied to the present invention. In this case, the second exposure, the second development and the fixing steps are unnecessary.

The reversal processing method of the present invention can be applied to any black and white light-sensitive materials such as those for general use, for cinema use, for microfilm, for X-ray, for industrial use or for printing use, and particularly is effective for microfilm use.

The present invention will be explained in more detail by the following examples.

EXAMPLE 1

A black and white light-sensitive material for microfilm (trade name: Fuji Com SE manufactured by Fuji Photo Film Co., Ltd.) composed of a cellulose triacetate film having coated thereon a gelatino silver iodobromide emulsion layer was exposed through a wedge, and then processed by means of a roller transporting type automatic developing machine by the following processing steps.

| | | Processing | |
|---|---|---|---|
| Step Number | Processing Step | Time (sec) | Temperature (°C.) |
| 1 | First development | 13 | 40 |
| 2 | Development stop | 13 | 24 |
| 3 | Bleach | 26 | 40 |
| 4 | Rinse and exposure | 13 | 24 |
| 5 | Second development | 13 | 40 |
| 6 | Wash | 13 | 24 |
| 7 | Dry | 30 | 45 |

Each processing step was carried out using the following processing solution.

| | |
|---|---|
| First Developing Solution | |
| Distilled Water | 700 ml |
| Hydroquinone | 30 g |
| Sodium Bisulfite | 90 g |
| Potassium Hydroxide | 100 g |
| 4,4-Dimethyl-3-pyrazolidone | 0.5 g |
| Potassium Bromide | 12 g |
| Sodium Thiosulfate (anhydrous) | 0.5 g |
| Distilled water to make | 1 l |
| Development Stop Solution | |
| Distilled Water | 700 ml |
| Sulfuric Acid (conc.) | 30 ml |
| Distilled water to make | 1 l |
| Bleaching Solution (A) | |
| Distilled Water | 700 ml |
| Cerium Sulfate | 50 g |
| Sulfuric Acid (conc.) | 8 g |
| Distilled water to make | 1 l |
| Rinsing Solution | |
| Distilled Water | 700 ml |
| Sodium Sulfite (anhydrous) | 100 g |
| Sodium Citrate | 10 g |
| Sodium Thiosulfate ($5H_2O$) | 0.5 g |
| Distilled water to make | 1 l |
| Second Developing Solution | |
| Distilled Water | 700 ml |
| Hydroquinone | 35 g |
| Potassium Sulfite | 100 g |
| Potassium Hydroxide | 10 g |
| 4,4-Dimethyl-3-pyrazolidone | 0.6 g |
| 1-Phenyl-5-mercaptotetrazole | 0.01 g |
| Distilled water to make | 1 l |

Various accelerators of the present invention shown in Table 1 were added to the development stop solution in the second stop of the present invention, and reversal processing method was carried out in the same manner as in the method in which the compound of the present invention was not used.

TABLE 1

| Sample No. | Bleach Accelerator | Amount (mol/liter) |
|---|---|---|
| Control | None | 0 |
| 1 | Compound (1) | $1.37 \times 10^{-2}$ |
| 2 | Compound (4) | 0.63 |
| 3 | Compound (13) | 0.29 |
| 4 | Compound (16) | 0.50 |
| 5 | Compound (18) | 0.49 |
| 6 | Compound (19) | 3.30 |
| 7 | Compound (23) | 0.71 |
| 8 | Compound (28) | 2.50 |
| 11 | Compound (33) | 1.50 |
| 12 | Compound (34) | 1.00 |
| 13 | Compound (36) | 1.40 |
| 14 | Compound (37) | 2.00 |
| 15 | Compound (38) | 1.5 |
| 16 | Compound (39) | 0.8 |
| 17 | Compound (42) | 2.0 |
| 18 | Compound (44) | 1.8 |

The results are shown in Table 2.

TABLE 2

| Sample No. | Fog | Contrast | Relative Sensitivity | Maximum Density |
|---|---|---|---|---|
| Control | 0.23 | 1.07 | 100 | 2.01 |
| 1 | 0.12 | 1.55 | 100 | 2.10 |
| 2 | 0.10 | 1.59 | 100 | 2.08 |
| 3 | 0.06 | 1.70 | 100 | 2.28 |
| 4 | 0.08 | 1.65 | 100 | 2.18 |
| 5 | 0.09 | 1.63 | 100 | 2.16 |
| 6 | 0.10 | 1.48 | 100 | 2.18 |
| 7 | 0.07 | 1.56 | 100 | 2.27 |
| 8 | 0.11 | 1.34 | 100 | 2.18 |
| 11 | 0.14 | 1.63 | 100 | 2.10 |
| 12 | 0.10 | 1.60 | 100 | 2.23 |
| 13 | 0.08 | 1.61 | 100 | 2.24 |
| 14 | 0.12 | 1.59 | 100 | 2.17 |
| 15 | 0.11 | 1.49 | 100 | 2.20 |
| 16 | 0.09 | 1.54 | 100 | 2.54 |
| 17 | 0.13 | 1.55 | 100 | 2.15 |
| 18 | 0.13 | 1.50 | 100 | 2.10 |

As is apparent from Table 2, images having less fog and high contrast are obtained using the bleach accelerating agents of the present invention.

EXAMPLE 2

The same procedure as in Example 1 was repeated except that the bleach-accelerating agents of the present invention were added to a bleaching solution (B) having the following composition. The compounds were added as shown in Table 3. In the case where the compounds were not added, the same procedure as above were repeated.

| Bleaching Solution (B) | |
|---|---|
| Distilled Water | 500 ml |
| Ferric Nitrate ($9H_2O$) | 600 g |
| Sulfuric Acid (conc.) | 100 g |
| Distilled water to make | 1 l |

TABLE 3

| Sample No. | Bleach Accelerator | Amount (mol/liter) |
|---|---|---|
| Control | None | 0 |
| 1 | Compound (2) | $0.63 \times 10^{-2}$ |
| 2 | Compound (5) | 0.53 |
| 3 | Compound (13) | 0.09 |
| 4 | Compound (16) | 0.50 |
| 5 | Compound (17) | 0.27 |
| 6 | Compound (23) | 0.5 |

TABLE 3-continued

| Sample No. | Bleach Accelerator | Amount (mol/liter) |
|---|---|---|
| 7 | Compound (25) (hydrochloride) | 2.5 |
| 8 | Compound (31) | 1.3 |
| 11 | Compound (35) | 1.0 |
| 12 | Compound (36) | 2.0 |
| 13 | Compound (37) | 1.5 |
| 14 | Compound (38) | 1.5 |
| 15 | Compound (39) | 1.5 |
| 16 | Compound (41) | 1.5 |
| 17 | Compound (42) | 1.5 |
| 18 | Compound (45) | 1.5 |

The results obtained are shown in Table 4.

TABLE 4

| Sample No. | Fog | Contrast | Relative Sensitivity | Maximum Density |
|---|---|---|---|---|
| Control | 0.35 | 0.98 | 100 | 2.05 |
| 1 | 0.10 | 1.23 | 100 | 2.11 |
| 2 | 0.11 | 1.20 | 100 | 2.07 |
| 3 | 0.08 | 1.38 | 100 | 2.25 |
| 4 | 0.09 | 1.32 | 100 | 2.25 |
| 5 | 0.09 | 1.31 | 100 | 2.23 |
| 6 | 0.09 | 1.51 | 100 | 2.11 |
| 7 | 0.10 | 1.50 | 100 | 2.15 |
| 8 | 0.11 | 1.40 | 100 | 2.20 |
| 11 | 0.13 | 1.32 | 100 | 2.13 |
| 12 | 0.11 | 1.45 | 100 | 2.18 |
| 13 | 0.12 | 1.30 | 100 | 2.20 |
| 14 | 0.11 | 1.40 | 100 | 2.25 |
| 15 | 0.10 | 1.40 | 100 | 2.20 |
| 16 | 0.14 | 1.37 | 100 | 2.14 |
| 17 | 0.15 | 1.28 | 100 | 2.16 |
| 18 | 0.13 | 1.30 | 100 | 2.15 |

As is apparent from Table 4, photographic images having less fog, high contrast and high maximum density are obtained by using the bleach-accelerating agents in the present invention in the bleaching solution.

While the invention has been described in detail and with reference to specific embodiments thereof, it will be apparent to one skilled in the art that various changes and modifications can be made therein without departing from the spirit and scope thereof.

What is claimed is:

1. In a method for reversal development processing for an imagewise exposed black and white silver halide photographic light-sensitive material which comprises a first development, a development stopping, a bleaching, a second exposure or chemical fogging and a second development with a developing solution, the improvement which comprises bleaching the light-sensitive material with a bleaching solution containing an oxidizing agent which converts a silver image which is present into a water-soluble silver salt, in the presence of at least one bleach-accelerating agent which is incorporated into the development stopping solution represented by the following formulae (I) to (III) and (V) to (VIII):

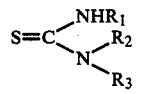

(I)

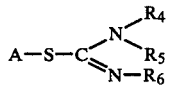

(II)

$D_1-R_7-S-B$ (III)

-continued (V)

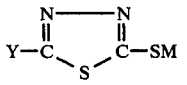

(VI)

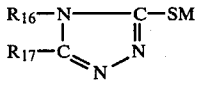

(VII)

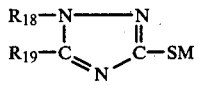

(VIII)

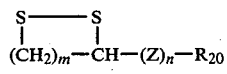

wherein $R_1$ to $R_6$ each is a hydrogen atom, a straight or branched chain alkyl group having 1 to 6 carbon atoms, a hydroxyalkyl group having 1 to 6 carbon atoms, a monocyclic aryl group or a monocyclic aralkyl group having 7 to 10 carbon atoms which may be substituted with a halogen atom or a sulfo group, provided $R_1$, $R_2$ and $R_3$ are not hydrogen atoms at the same time, or $R_1$ and $R_2$, $R_2$ and $R_3$, $R_4$ and $R_5$ or $R_5$ and $R_6$ may combine to form a saturated or unsaturated 5-membered ring such as an imidazole ring imidazoline ring, A is a hydrogen atom or a hydrocarbon group having 1 to 10 carbon atoms which may be substituted with a carboxy group, a sulfo group, a hydroxy group, an amino group or an alkylamino group, $D_1$ is a hydrogen atom a hydroxy group or

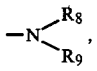

$R_8$ and $R_9$ each is a hydrogen atom, a methyl group or an ethyl group, $R_7$ is an alkylene group having 1 to 4 carbon atoms which may be substituted with a hydroxy group, a mercapto group or a carboxy group, B is a hydrogen atom or —S—$R_{10}$—$D_2$, where $D_2$ is a hydrogen atom, a hydroxy group or

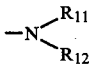

in which $D_1$ and $D_2$ are not hydrogen atoms at the same time, $R_{11}$ and $R_{12}$ have the same definition as $R_8$ and $R_9$, $R_{10}$ has the same definition as $R_7$, Y is —SM, an amino group, an alkylamino group having 1 to 3 carbon atoms, —$SR_{15}$ or —$R_{15}$, $R_{15}$ is a straight or branched chain alkyl group having 1 to 4 carbon atoms, a straight or branched chain alkoxy group having 1 to 4 carbon atoms, an allyl group or an unsubstituted or substituted phenyl group, $R_{16}$, $R_{17}$, $R_{18}$ and $R_{19}$ each is a hydrogen atom, a straight or branched chain alkyl group having 1 to 4 carbon atoms, a straight or branched chain alkoxy group having 1 to 4 carbon atoms or an unsubstituted or substituted phenyl group, Z is an alkylene group having 1 to 6 carbon atoms, $R_{20}$ is a carboxy group, a carboxylic acid salt group, a carboxylic acid ester group or a carboxylic acid amido group, m is 2 or 3, n is 0 or 1, and M is a hydrogen atom, an alkali metal atom, an ammonium ion, a straighr or branched chain alkyl group having 1 to 4 carbon atoms or an alkoxy group having 1 to 4 carbon atoms.

2. The reversal processing method of claim 1, wherein the substituted phenyl groups for $R_{15}$ to $R_{19}$ are phenyl groups substituted with a halogen atom, a nitro group, a carboxyl group, a hydroxyl group, a straight or branched chain alkyl group having 1 to 5 carbon atoms, a straight or branched chain alkoxy group having 1 to 5 carbon atoms or a sulfo group which may be an alkali metal salt or an ammonium salt, and M is a hydrogen atom, an alkali metal atom, an ammonium ion, a straight or branched chain alkyl group having 1 to 4 carbon atoms or an alkoxy group having 1 to 4 carbon atoms.

3. The reversal processing method of claim 1, wherein said bleach-accelerator is a compound selected from

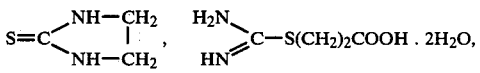

dimethylaminoethanthiol

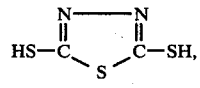

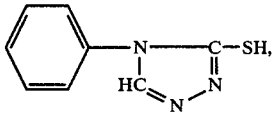

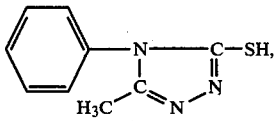

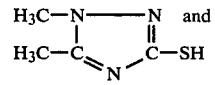

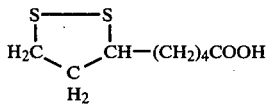

4. The reversal processing method of claim 1, wherein the bleaching solution contains an inorganic ferric salt as an oxidizing agent.

5. The reversal processing method of claim 1, wherein the bleaching solution contains a persulfate as an oxidizing agent.

6. The reversal processing method of claim 1, wherein the bleaching solution contains a cerium salt as an oxidizing agent.

7. The reversal processing method of claims 4, 5 or 6, wherein an anion of the oxidizing agent in the bleaching solution is a sulfate ion.

8. The reversal processing method of claims 4, 5 or 6, wherein an anion of the oxidizing agent in the bleaching solution is a nitrate ion.

9. The reversal processing method of claims 1, wherein the bleach-accelerating agent is incorporated in an amount of about 0.0001 mol/liter to the solubility of the agent.

10. The reversal processing method of claim 1, wherein $D_1$ and B are not hydrogen at the same time.

11. The reversal processing method of claim 1, wherein said hydrocarbon group represented by A is an alkylene group.

12. The method of claim 1, wherein said silver image is directly converted to said water-soluble silver halide salt without rehalogenation.

13. The method of claim 1, wherein said bleach-accelerating agent does not have any chemical effect on silver halide present.

14. The reversal processing method of claim 1, wherein the second developing solution contains one or more dihydroxybenzenes.

15. The reversal processing method of claim 1, which comprises a first development, development stopping, bleaching, rinsing, a second exposure, and a second development.

* * * * *